US005148636A

United States Patent [19]

Judge et al.

[11] Patent Number: 5,148,636

[45] Date of Patent: Sep. 22, 1992

[54] SIZE CONTROL SHOE FOR MICROFINISHING MACHINE

[75] Inventors: Edward E. Judge; Lowell W. Bennickson; Arthur G. Reiser, all of Lansing, Mich.

[73] Assignee: Industrial Metal Products Corporation, Lansing, Mich.

[21] Appl. No.: 695,689

[22] Filed: May 3, 1991

Related U.S. Application Data

[62] Division of Ser. No. 307,622, Feb. 7, 1989, Pat. No. 5,095,663.

[51] Int. Cl.[5] ..... B24B 21/00

[52] U.S. Cl. ..... 51/142; 51/145 R; 51/281 C; 51/165.91

[58] Field of Search ..... 51/62, 135 R, 141, 145 R, 51/147, 151, 154, 161, 165.91, 204, 281 C, 289 R, 326, 328

[56] References Cited

U.S. PATENT DOCUMENTS 4,682,444 7/1987 Judge et al. ..... 51/154

*Primary Examiner*—M. Rachuba

*Attorney, Agent, or Firm*—Harness, Dickey & Pierce

[57] ABSTRACT

Microfinishing devices and processes for in-process gauging of a microfinishing process of generally cylindrical workpieces. A size control shoe is used with a microfinishing shoe such that the diameter of a generally cylindrical workpiece can be continually monitored during the microfinishing process. Once a predetermined diameter or workpiece geometry is achieved, the machining process can be terminated. Several embodiments of size control shoes are disclosed which are particularly adapted for retrofit applications for existing microfinishing equipment. A "masterless" microfinishing machine is also described having arms which engage the size control and microfinishing shoes which follow the path of the workpiece during machining. Since the shoes must be maintained in engagement with the workpiece after a desired diameter is achieved, the pressure applied by the microfinishing arms is relieved until all of the workpiece surfaces are machined. Methods incorporating periodic reversing of the direction of rotation of the workpiece relative to the shoes are also described which provide enhanced material removal rate and high accuracy.

6 Claims, 11 Drawing Sheets

SIZE CONTROL SHOE FOR MICROFINISHING MACHINE

This is a division of U.S. patent application Ser. No. 307,622, filed Feb. 7, 1989, now U.S. Pat. No. 5,095,663.

BACKGROUND OF THE INVENTION

This invention relates to metal finishing and particularly to improved devices and methods for microfinishing metal surfaces using in-process gauging techniques, and for holding and guiding microfinishing shoes.

Numerous types of machinery components require carefully controlled surface finishes in order to perform satisfactorily. For example, surface finish control, also referred to as microfinishing, is particularly significant in relation to the machining of journal bearing and cam surfaces such as are found on internal combustion engine crankshafts, camshafts, power transmission shafts, etc. For journal bearings, very accurately formed surfaces are needed to provide the desired hydrodynamic bearing effect which results when lubricant is forced under pressure between the journal and the confronting bearing surfaces. Improperly finished bearing surfaces can lead to premature bearing failure and can also limit the load carrying capacity of the bearing.

Currently, there is a demand for more precision control of journal bearing surfaces by internal combustion engine manufacturers as a result of greater durability requirements, higher engine operating speeds (particularly in automobiles), the greater bearing loads imposed through increased efficiency of engine structures, and the desire by manufacturers to provide "world class" quality products.

Significant improvements in the art of microfinishing journal bearing surfaces have been made by the assignee of the present application, the Industrial Metal Products Corporation (hereinafter "IMPCO"). IMPCO has produced a new generation of microfinishing equipment and processes referred to as "GBQ" (an abbreviation for "Generating Bearing Quality" and a trademark of IMPCO). The machines have microfinishing shoes which clamp around the journal with rigid inserts that press an abrasive coated film against the bearing surface. IMPCO's GBQ machines and processes are encompassed by U.S. Pat. No. 4,682,444, which is hereby incorporated by reference. The new generation IMPCO machines and processes have been found to provide excellent microfinishing surface quality as well as having the ability to correct geometry imperfections in bearing surfaces which are generated through grinding processes which precede microfinishing.

This specification is directed to further refinements in microfinishing machines and processes in which in-process gauging devices and techniques are employed. In accordance with this invention, size control gauging shoes are provided which continuously measure the diameter of the journal surface. The size control shoe is used in conjunction with a microfinishing shoe on a journal surface, so that, as the workpiece is rotated with respect to the shoes causing the abrasive film to remove material, the size control shoe continuously measures journal diameter. The diameter information is used to stop material removal once the desired diameter is reached. A workpiece having a number of journal surfaces such as a multi-cylinder internal combustion engine crankshaft would preferably have individual sets of size control and microfinishing shoe assemblies engaging each journal simultaneously. When the size control shoe provides an output indicative of a desired diameter for that journal, the pressure applied by the microfinishing shoe against the abrasive film on that journal is relieved while machining continues on the others until the correct diameters are reached for each journal.

Gauging devices for this application must be accurate, durable, and be able to accommodate significant workpiece "wobble" during rotation caused by eccentricity and/or lobing of the journal. In order to facilitate use, an in-process gauge for microfinishing would preferably be attached to conventional microfinishing shoe mounts, thus facilitating simple retrofit applications. Moreover, for use in gauging journal surfaces on crankshafts, the device must not extend beyond the axial ends of the journal where interference with the crankshaft would occur.

Numerous types of workpiece diameter in-process gauge devices are known according to the prior art. For example, various optical techniques have been employed in the past for gauging applications. These devices are not, however, well suited for microfinishing use since they are subject to reliability and accuracy problems due to the severe operating environment where they would be exposed to intense vibration, high temperatures, and contamination by cutting fluids, machining grit, etc. For these reasons, mechanical contact gauges are best suited for microfinishing applications of the type described above. Since many diameter gauges contact the workpiece at two diametrically opposite points, one design approach would be to use a pair of gauges for detecting the position of each contact probe with respect to the support structure, and using their outputs to calculate workpiece diameter. Such systems are, however, not favored since the use of two separate gauging devices gives rise to compound errors, high cost and complexity, etc.

In accordance with this invention, numerous embodiments of size control shoes are provided which enable accurate diameter measurements of journaled surfaces and use a single measuring gauge carried by a conventional microfinishing shoe hanger.

Microfinishing tooling such as that described previously is mounted to a microfinishing machine which positions the tools in contact with the workpiece surface, applies the desired pressure on the tooling and in many applications, allows the tooling to follow an orbital path of the workpiece journal during microfinishing. Presently available microfinishing machines perform these functions in an acceptable manner but have the disadvantage that in order to follow the orbital path of a workpiece surface, such as the rod journals of an internal combustion engine crankshaft, they must be specially set up for this workpiece configuration and require significant reworking to enable the machine to be used with workpieces of other configurations. Accordingly, it is another object of the present invention to provide a microfinishing machine which provides a large degree of flexibility enabling it to be used with workpieces of varying configurations without extensive reworking.

SUMMARY OF THE INVENTION

In accordance with the present invention, several embodiments of size control shoes are provided having a housing which supports one or more caliper arms, each having a probe tip which contacts the journal. In one embodiment, a pair of caliper arms are mounted to the housing by cantilever springs. A gauging device measures the difference in position between the two caliper arms and thus provides an output related to workpiece diameter. The support structure has a pair of circumferentially separated bearing pads which contact the journal surface and properly position the probes at the diameter of the workpiece. These inventors have found that an optimal contact angle range exists for the bearing pads against the workpiece journal surface. If the included contact angle is above this range, the size control shoe is not maintained in the desired position once pressure against the workpiece is relieved, which occurs once a desired journal diameter is reached. In an alternate embodiment, a single caliper arm is used and a portion of a gauge device is mounted directly to a probe tip. In still another embodiment, a "V" block arrangement is used having a single probe tip contacting the journal surface.

The support structure of the size control shoes of this invention can be mounted to a conventional microfinishing shoe hanger, thereby minimizing reworking of existing equipment.

One preferred gauge for use with the size control shoes according to this invention is an air jet type gauge in which pressurized air is exhausted through an orifice and impinges against a surface which has a variable distance from the orifice, depending on the relative position of the caliper arms. Air pressure through the orifice is related to the gap distance between the orifice and plug. Air jet gauge systems are inherently resistant to contaminants since a continuous source of clean air blows through the device. Moreover, such gauges are readily available and inexpensive. Several embodiments of this invention implement electrical column type gauging devices which are also presently available as off-the-shelf items. In still another embodiment, a simple probe contacts the workpiece in the manner of a conventional "V" block diameter gauge.

This invention also contemplates novel methods for use in accurately machining journal bearing surfaces. These inventors have found that periodic reversing of the direction of relative rotation between the microfinishing shoe and workpiece produces accelerated material removal rates initially. Continued rotation in a particular direction results in decreasing material removal rate since the abrasive coated film "loads up" and becomes less sharp with time. Upon reversal of the direction of rotation, the abrasive film again initially behaves more like a fresh abrasive surface. When attempting to accurately control workpiece diameter, it is undesirable to reverse the direction of rotation at the threshold of reaching the desired diameter since the resulting initially high material removal rate can cause the system to "overshoot" the desired diameter. Accordingly, this invention contemplates methods in which the direction of rotation is not reversed when the workpiece diameter is very close to reaching the desired diameter.

Another feature of this invention is a so-called "masterless" machine for use with microfinishing tooling. When microfinishing the rod bearing journals of a crankshaft, for example, the microfinishing shoe must follow the eccentric path of the rod journal since the crankshaft is typically rotated about its main bearing journals. In conventional microfinishing machines for crankshafts, internal crankshafts matching the configuration of the crankshafts being machined are used to guide the microfinishing shoes to precisely follow the eccentric path of the rod journals. In the masterless machines of this invention, the microfinishing shoes for the connecting rod journals are allowed to freely follow the path of the crankshaft rod journal, thus making the machine readily adaptable to crankshafts of varying configurations without machine reworking. In accordance with this invention, once the desired diameter is reached as measured by the size control gauge, the pressure applied against the microfinishing shoe is reduced to stop the machining effect while maintaining the shoes in engagement with the workpiece so they can follow its eccentric path. Masterless microfinishing machines have been previously manufactured by applicant. Although such machines generally provide the above mentioned features, the microfinishing shoes were not rigidly maintained in a set position once the microfinishing shoes were opened. For these machines, vibrations or other force inputs could cause the microfinishing shoes to move out of position such that they would not properly engage a subsequent workpiece for another machining operation. The masterless machine of this invention provides means for firmly restraining the motion of the guide arms which support the microfinishing shoes between machining cycles.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE INVENTION

Figure 1:
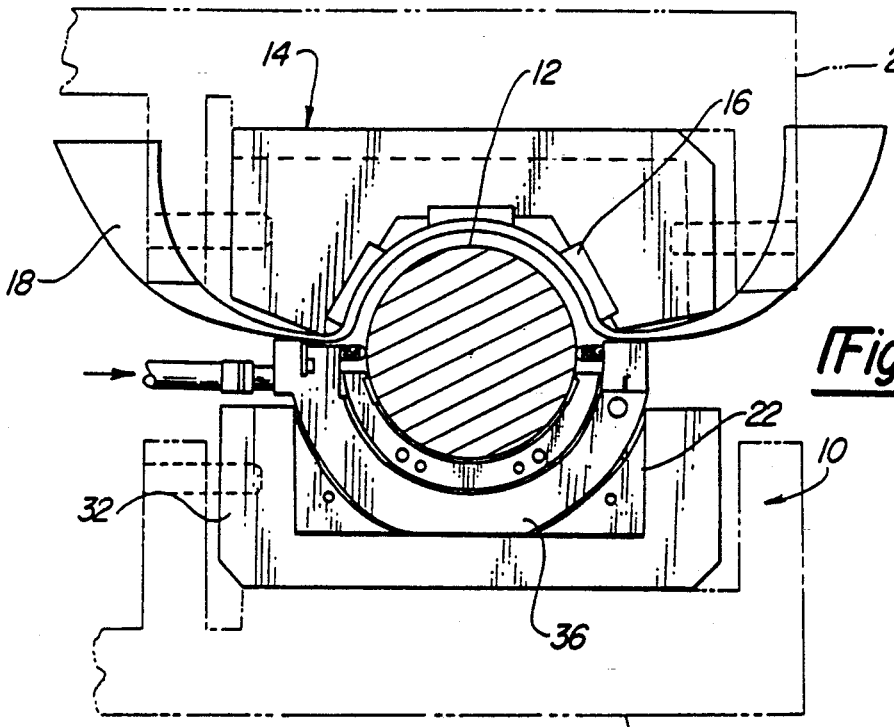
FIG. 1 is a cross-sectional view through a workpiece journal showing a size control shoe according to a first embodiment of the invention with a side cover removed and being used in conjunction with a microfinishing shoe.

With reference to FIG. 1, a size control shoe in accordance with a first embodiment of this invention is shown and is generally designated by reference number 10. Size control shoe 10 is shown in use gauging the diameter of workpiece journal 12 which is simultaneously being machined by microfinishing shoe 14. In accordance with the teachings of applicant's previously issued U.S. Pat. No. 4,682,444, microfinishing shoe 14 employs several rigid inserts 16 which press an abrasive coated film 18 against journal 12, causing its surface to be microfinished and correcting geometry errors. Both size control shoe 10 and microfinishing shoe 14 are mounted to support arms 20 which cause them to be clamped around journal 12 during the microfinishing operation and enables them to be separated for workpiece removal and loading. During use of the mechanism shown in FIG. 1, workpiece journal 12 is rotated relative to shoes 10 and 14, causing material removal along its outer surface. Shoes 10 and 14 are also stroked axially along journal 12 to produce a desirable cross-hatched scratch pattern in the part surface. Once an appropriate signal is outputted by size control shoe 10 indicating that the part has been reduced to the desired diameter, support arms 20 separate slightly to relieve pressure applied on film 18 against the workpiece, or are separated sufficiently to allow loading and unloading of parts (usually only after the workpiece rotation is stopped).

Details of the components of size control shoe 10 are best described with particular reference to FIGS. 2 through 6. Gauge block 22 is the support structure for the remaining gauge components and has a semi-circular central surface 24 which accepts the workpiece. A pair of circumferentially separated support pads 26 are mounted to block 22 along surface 24 and directly contact workpiece journal 12 to position size control shoe 10 in the manner of conventional gauge "V" blocks. Support pads 26 are preferably made from a hard and wear resistant material such as tungsten carbide. Block 22 has a pair of aligned blind bores 28 which enable the shoe to be supported by pins 30 carried by shoe hanger 32. Pins 30 enable size control shoe 10 to pivot slightly to self-align with journal 12. Gauge block 22 further has a semi-circular groove 34 which accommodates a pair of caliper arms 36 and 38. Outer caliper arm 36 has a probe tip 40 made from a hard material which directly contacts workpiece journal 12. Similarly, inner caliper arm 38 includes probe tip 42 which engages workpiece journal 12 at a point diametrically opposite the point of contact of probe tip 40.

Outer and inner caliper arms 36 and 38 are each coupled to gauge block 22 by a pair of separated support posts 44. The support posts are made from spring steel, thus providing cantilever spring action. Support posts 44 are attached to gauge block 22 within bores 46 which have an enlarged portion 47 and are retained by set screws 48 in the smaller diameter bottom end 49 of the bore. The opposite end of support posts 44 are received by bores 50 within the caliper arms and are retained by set screws 52. Since each of caliper arms 36 and 38 are supported by a pair of separated support posts 44, they are permitted to shift laterally in the direction of the diameter measurement of journal 12, while being restrained from moving vertically due to the high column and tensile stiffness of the posts. The internal components of size control shoe 10 are enclosed by a side cover 70 held in place by cover screws 72, and an upper cover 74 retained in place by screws 76.

Figure 5B:
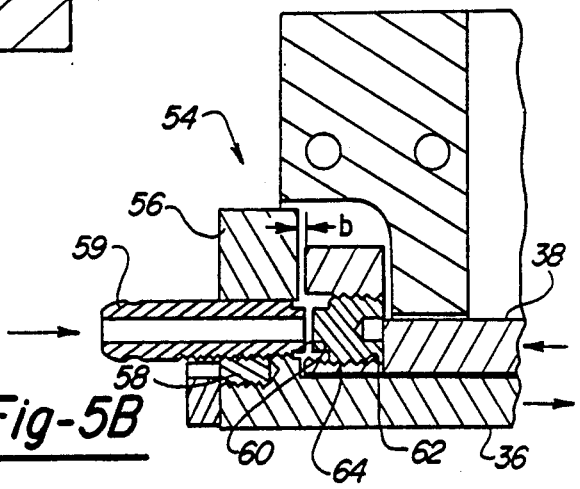
FIG. 5B is a view similar to FIG. 5A but showing relative displacement of the two caliper arms illustrating that such displacement produces a change in the gauge air gap.
Figure 5A:
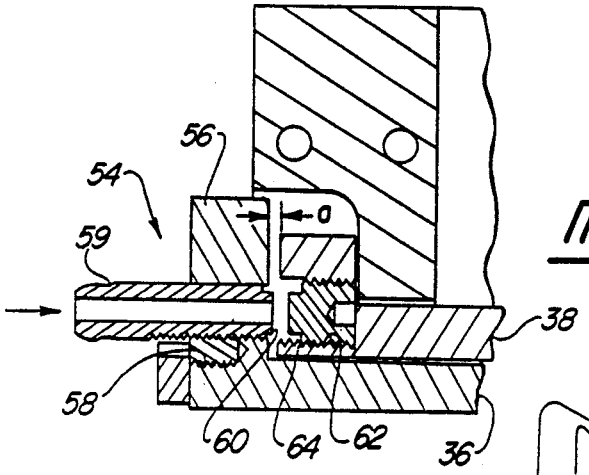
FIG. 5A is a cutaway enlarged cross-sectional view taken along line 5—5 of FIG. 2 particularly showing the air jet gauge assembly.
Figure 6:
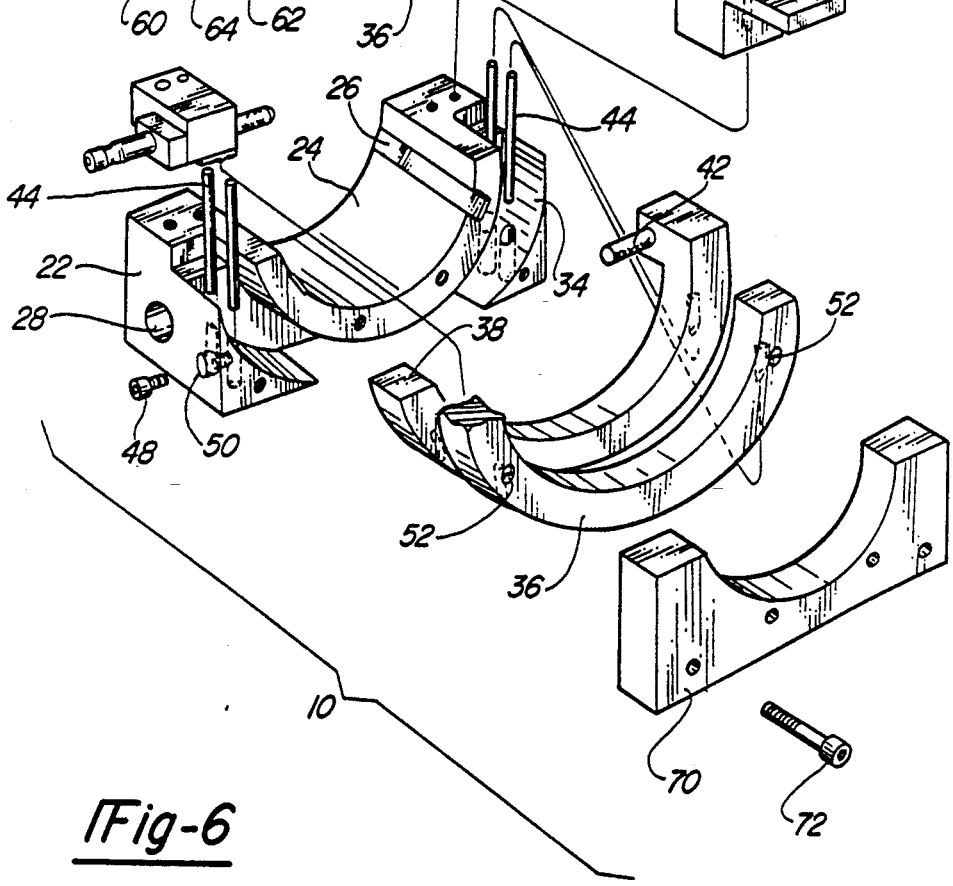
FIG. 6 is an exploded pictorial view of the size control shoe according to the first embodiment of this invention.

In accordance with a principal feature of this invention, a single gauging device is used to measure the differential in positioning of caliper arms 36 and 38 to thereby provide a diameter measure. An example of a gauge assembly which provides such measurement is air jet gauge assembly 54 which is particularly shown in FIGS. 5A and 5B. Outer caliper arm 36 includes an end plate 56 having a threaded bore 58 which receives air jet tube 59 having orifice 60. Inner caliper arm 38, in turn, has a bore 62 which receives threaded plug 64. Plug 64 directly opposes orifice 60 and is separated from the orifice by a small gap distance. Different air gap distances are designated by dimensions "a" in FIG. 5A and "b" in FIG. 5B, and vary with the diameter of the workpiece. FIG. 5A illustrates a representative starting condition for a workpiece prior to machining. As the diameter decreases during machining, as designated in FIG. 5B, caliper arms 36 and 38 shift in the direction of the arrows to decrease the separation distance between plug 64 and orifice 60. When such a decrease in gap distance occurs, the pressure of air being blown through tube 59 increases which is registered by appropriate remote gauge instruments in accordance with well known principles. Once a predetermined pressure is measured indicating that the desired diameter has been reached, the machining operation is stopped. A size control shoe constructed in accordance with the foregoing by these inventors provided a diameter measurement accuracy in the 2.5 micron range.

Due to the use of posts 44 for supporting caliper arms 36 and 38, radial runout of the surface due to eccentricity and/or lobing is accommodated as it is rotated without affecting diameter measurement accuracy. As the workpiece journal surface shifts in the direction of diameter measurements, caliper arms 36 and 38 are permitted to shift and remain in engagement with the workpiece. If no diameter changes occur, no difference in position between the arms will be detected, despite the wobbling motion. Support posts 44 are intentionally positioned so that a contact force is exerted on probe tips 40 and 42 against the workpiece.

Figure 8:
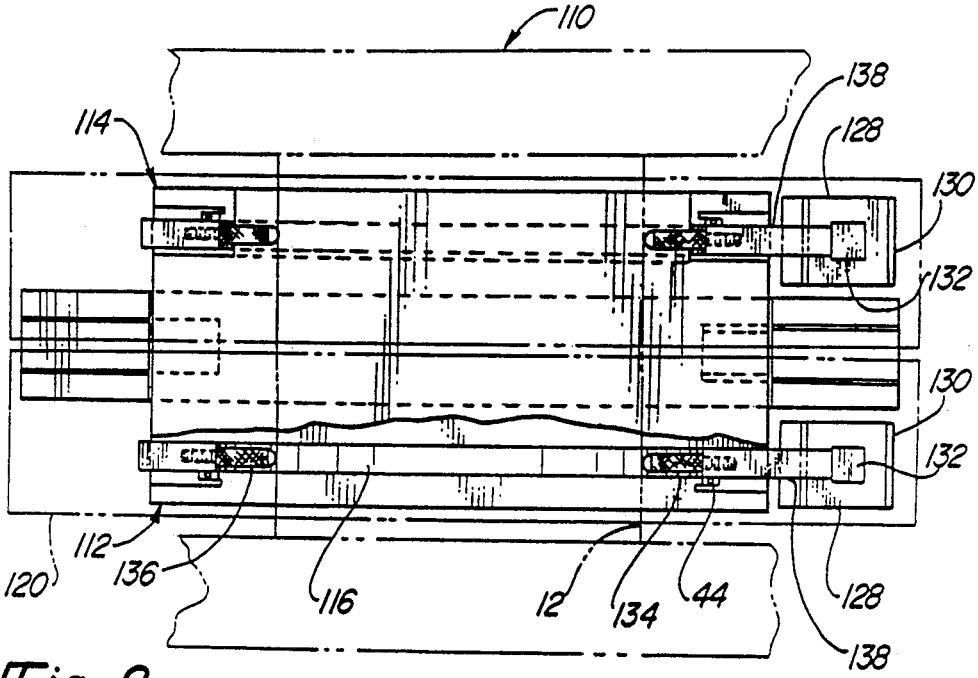
FIG. 8 is a top view of the size control shoe shown in FIG. 7.
Figure 7:
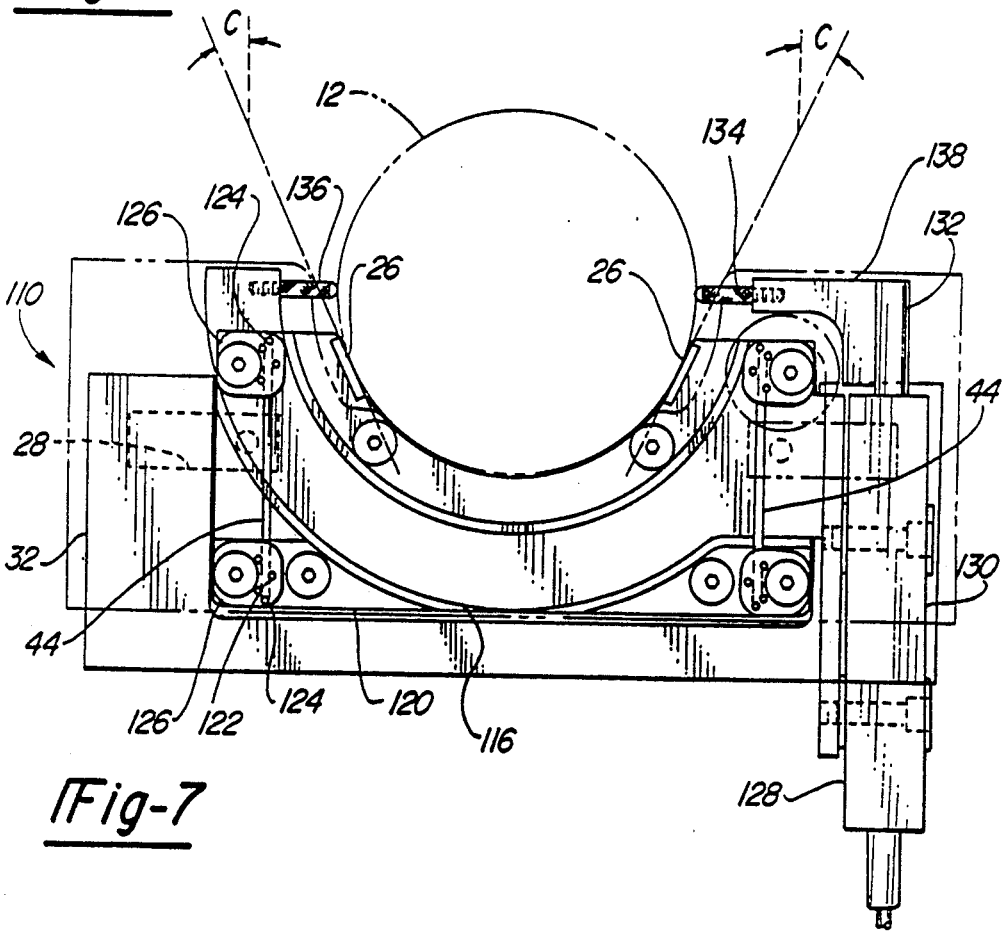
FIG. 7 is a side elevational view of a size control shoe in accordance with a second embodiment of the present invention which provides diameter measurements at two axially displaced positions along a journal surface and employs an electric column type gauge.
Figure 9:
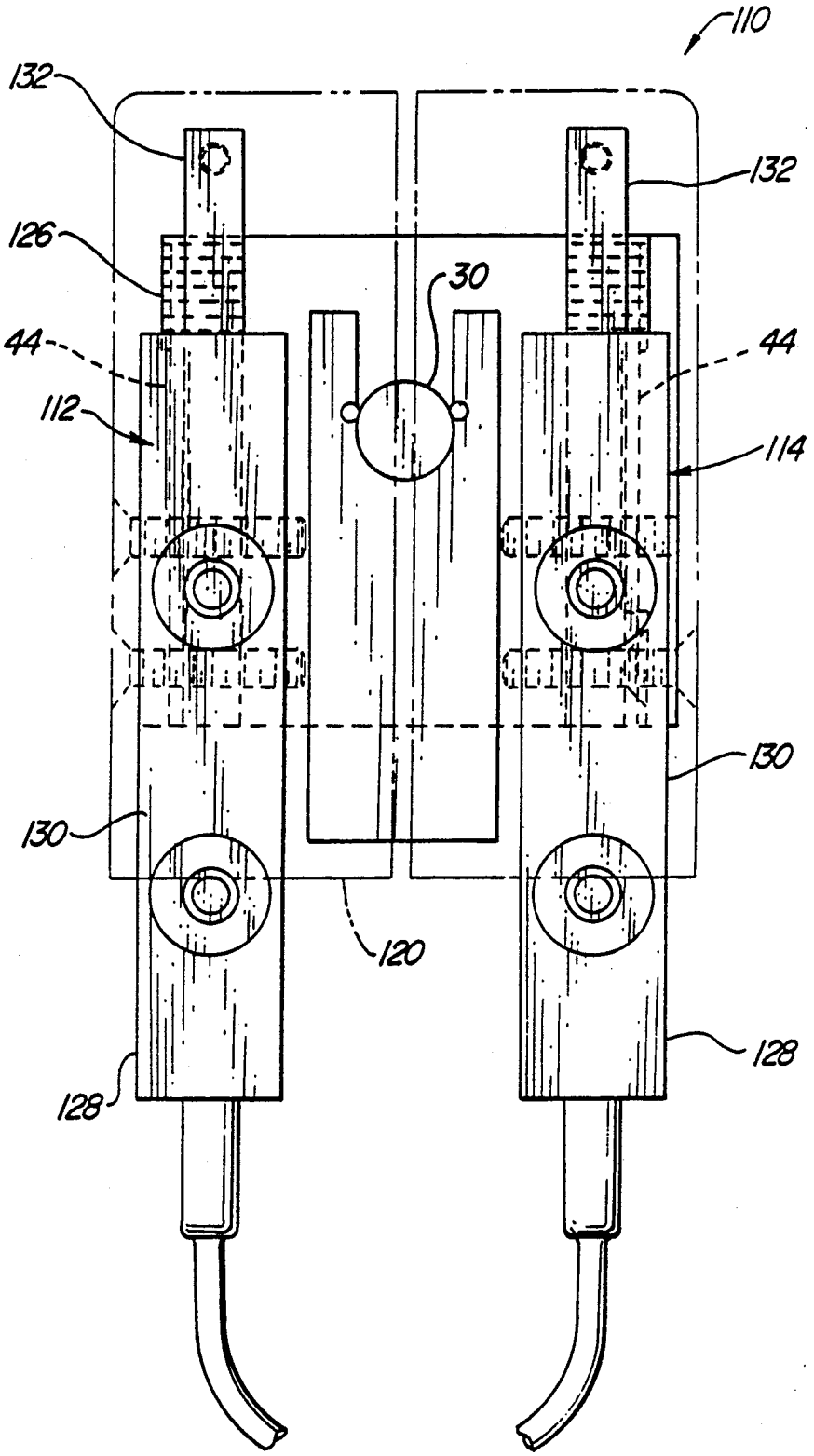
FIG. 9 is an end view of the size control shoe shown in FIG. 7.

Now with reference to FIGS. 7 through 9, an alternate embodiment of the present invention is shown. Components of shoe 110 which are identical to those of shoe 10 are identified by like reference numbers. Size control shoe 110 employs a pair of individual size control gauges 112 and 114, enabling diameters to be measured at axially displaced positions. Such measurements enable enhanced control over journal configurations to control journal geometry deviations such as tapering, etc. Size control shoe 110 also varies from that described previously in several other respects. In particular, the gauge used with this embodiment is an electrical transducer and each size control gauge uses a single caliper arm.

Since each of gauges 112 and 114 of shoe 110 are identical, only gauge 112 will be described in detail. Gauge 112, like the previous embodiments, includes a single caliper arm 116, which is mounted to housing 120 by support posts 44. A group of four pins 124 is used to mount support post 44 and cover 26 enclosing them after installation. Similarly, pins 124 are used to support the upper portion of support posts 44 within bores in caliper arm 116. For this embodiment, electrical transducer 128 is used as a gauge and has a body portion 130 and deflectable arm 132. Transducer 128 provides an output responsive to the degree of pivoting of arm 132 with respect to body 130. For this embodiment, caliper arm 116 which carries probe tip 136 is connected to gauge body 130. Probe tip 134 is fastened to transducer arm 132 by bracket 138.

In operation, size control shoe gauges 112 and 114 operate in a fashion similar to that of size control shoe 10, in that both probe tips 134 and 136 are permitted to float laterally while the gauge provides an output related to their difference in positioning as a diameter measure. Caliper arm 116 is supported by a pair of separated spring arms 44, allowing the arm to float in the direction of diameter measurements, but being rigid with respect to vertical loads such as are imposed by the frictional contact between the gauge tips and the workpiece.

Figure 10:
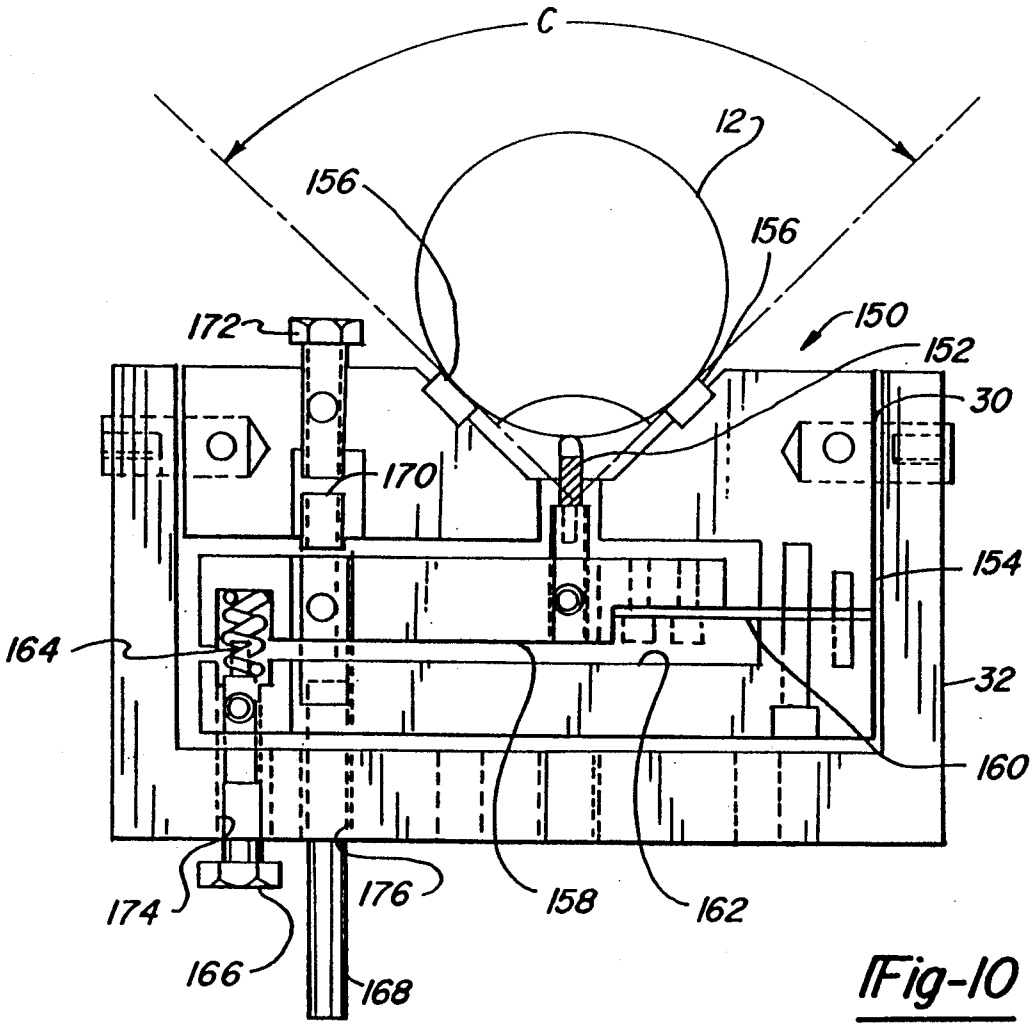
FIG. 10 is a side view of a size control shoe in accordance with a third embodiment of this invention using a single probe tip and operating in the manner of a "V" block diameter gauge.

FIG. 10 illustrates a third embodiment of a size control shoe according to this invention which is generally designated by reference number 150. The size control shoe differs from those described previously in that it employs only a single probe tip 152. Housing 154 includes a pair of hard inserts 156 which engage journal 12 in the manner of a conventional "V" block type diameter gauge. Probe tip 152 is connected to gauge arm 158 which is supported by cantilever leaf spring 160 fastened to housing 154. Housing 154 defines a clearance space 162 for movement of gauge arm 158. Coil spring 164 acts on gauge arm 158 to maintain probe tip 152 in engagement with the workpiece. Tension adjusting screw 166 is provided to enable the biasing force applied by coil spring 164 to be varied. Size control shoe 150 employs an air gauge type gauging device as described in connection with the first embodiment. Air is blown through tube 168 and escapes through orifice 170. Adjustable plug 172 is provided which defines the air gap at orifice 170. Changes in diameter of workpiece surface 12 cause movement of gauge arm 158, which in turn changes the air gap distance between orifice 170 and plug 172. Like the previous embodiments, size control shoe 150 is adapted to be carried by shoe hanger 32 via support pins 30. For this embodiment, shoe hanger 32 defines clearance openings 174 and 176 to provide passage for adjusting screw 166 and tube 168, respectively.

Figure 2:
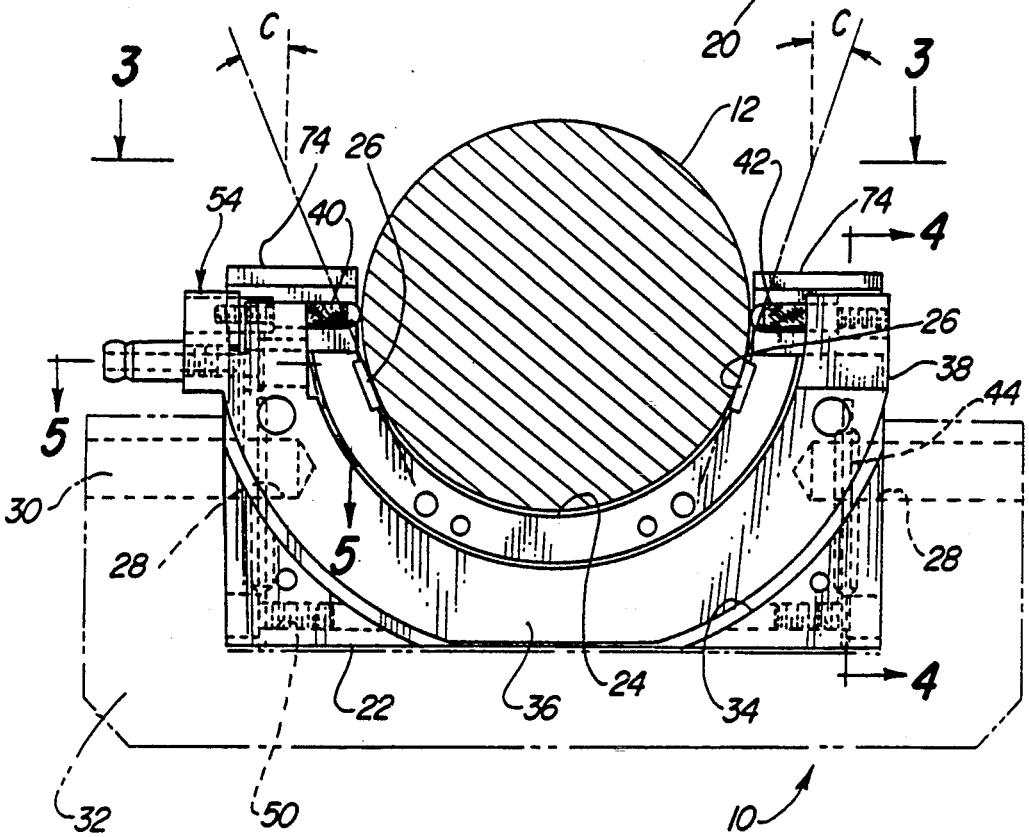
FIG. 2 is an enlarged cross-sectional view particularly showing the construction of the size control shoe shown in FIG. 1.
Figure 3:
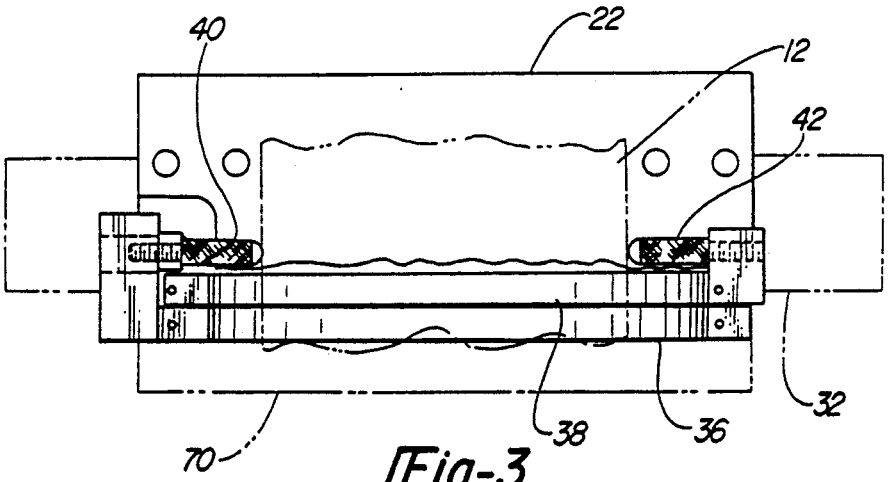
FIG. 3 is a top view taken in the direction of arrows 3—3 of FIG. 2.
Figure 4:
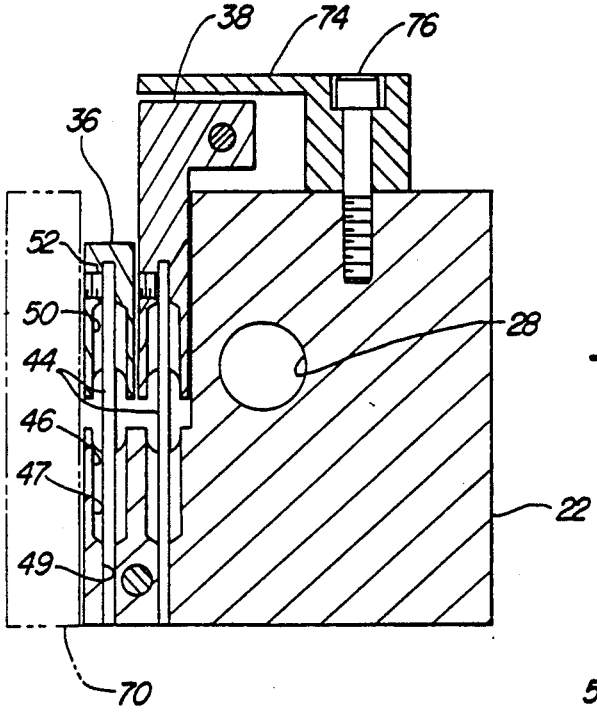
FIG. 4 is a cross-sectional view taken along line 4—4 of FIG. 2.

In the course of development of the present invention, the inventors found that in many applications, it was necessary to provide a proper location of support pads 26 with respect to the workpiece surface. As shown in FIGS. 2, 7 and 10, an angle designated by letter "C" is formed by the position of contact of support pads 26 to the workpiece relative to a vertical line. If the lines tangent to the workpiece at both support pads 26 are caused to intersect, a total included angle equivalent to two times "C" is constructed. If the included angle is excessively great, the size control shoe will tend to slip off workpiece journal 12, especially when the tooling is used with the "masterless" microfinishing machine as described below in which pressure is relieved from the tooling once a desired diameter is reached. If angle "C" is decreased to less than 45 degrees (an included angle of 90 degrees), support pads 26 will engage the workpiece in a manner that tends to maintain the size control shoe in the desired position with respect to the workpiece. In some applications, if angle "C" becomes excessively small, i.e., less than 20 degrees, (an included angle less than 40 degrees), a locking angle condition can occur which makes it difficult to remove the size control shoe from the workpiece journal 12 after machining. These inventors have found an angle "C" of 25 degrees (included angle of 50 degrees) to be optimal for many applications.

Figure 11:
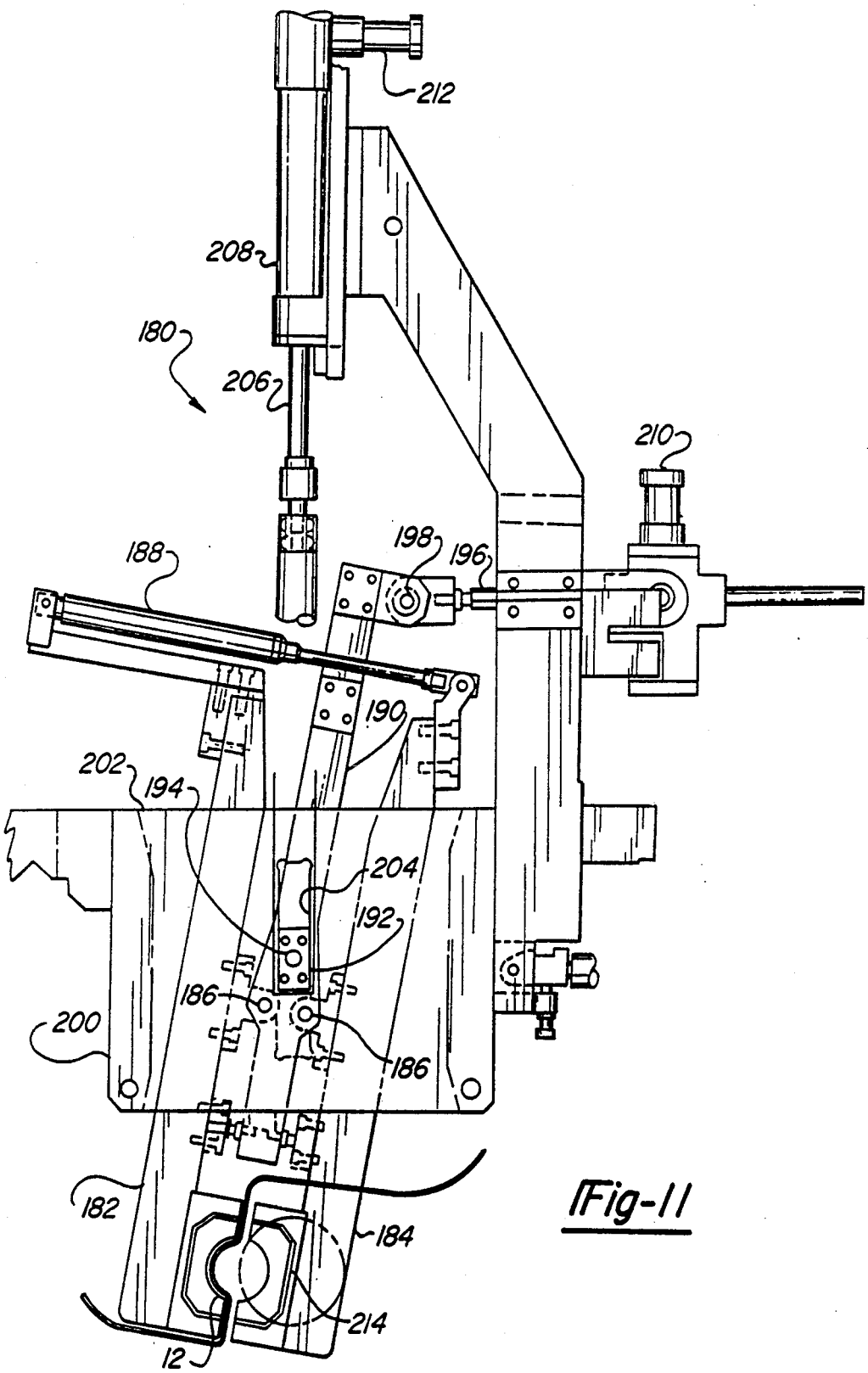
FIGS. 11 through 13 are side elevational views of a "masterless" type microfinishing machine in accordance with this invention which may be used in conjunction with the size control shoes of this invention.
Figure 12:
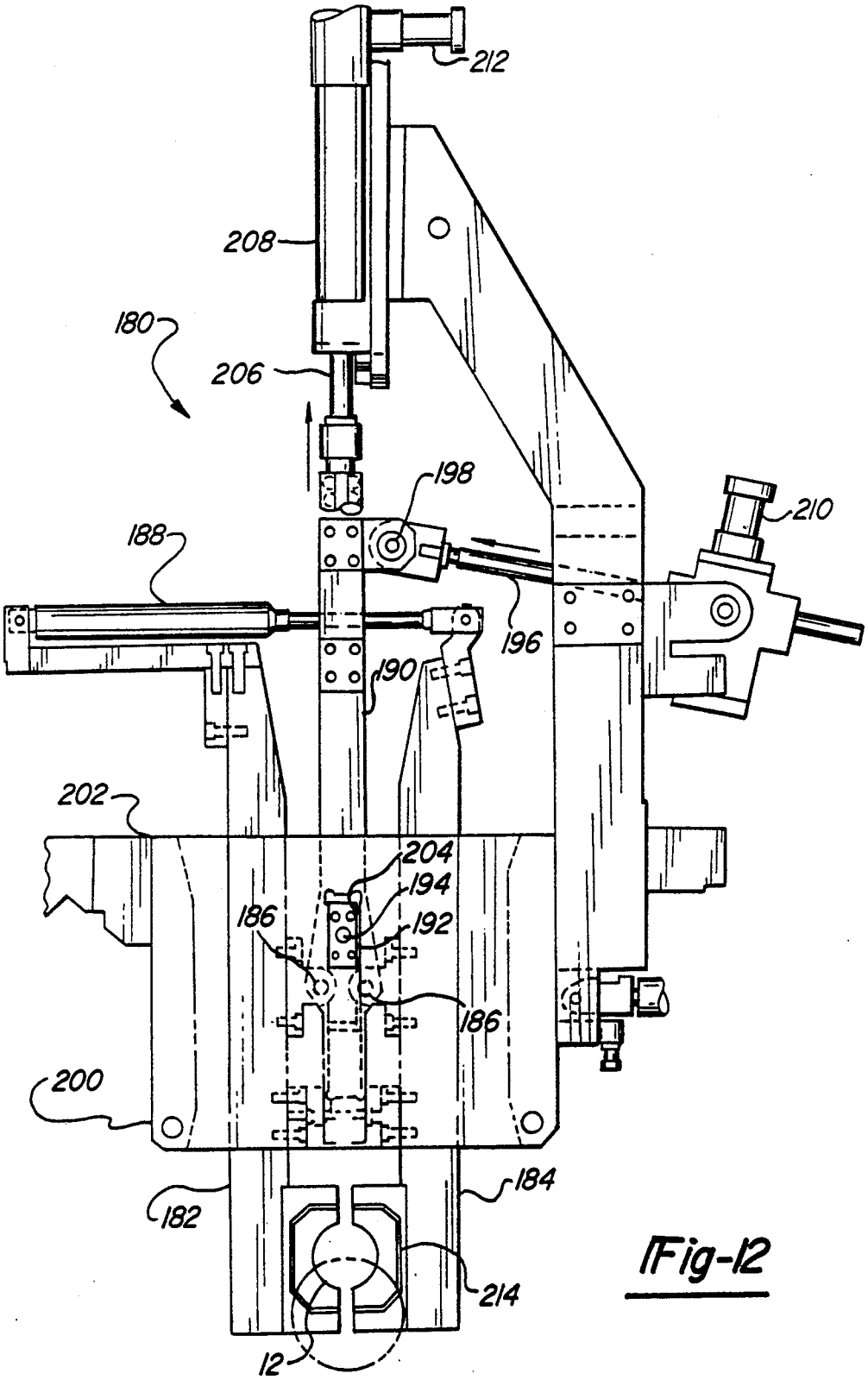
Figure 13:
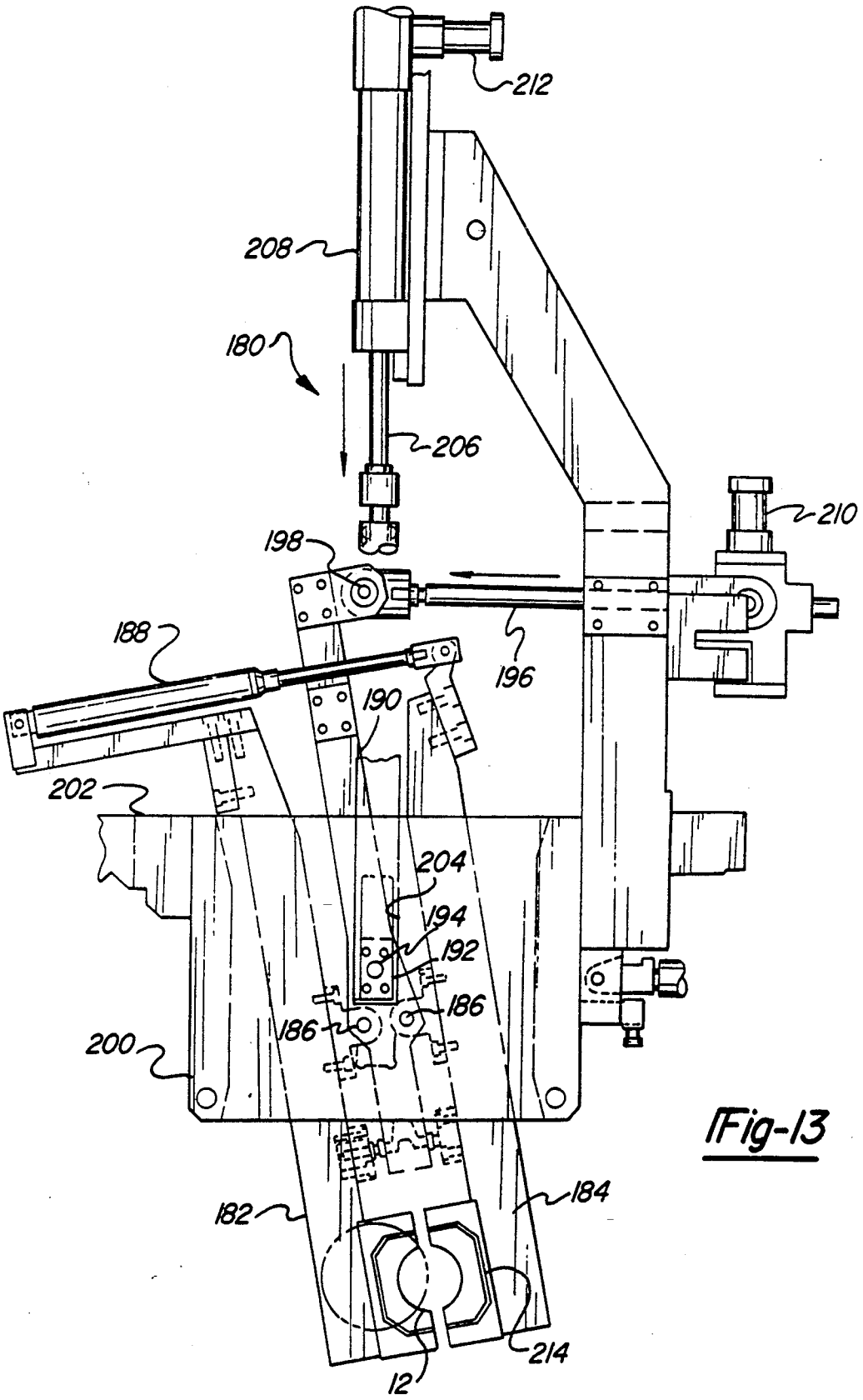

Now with particular reference to FIGS. 11 through 13, a microfinishing machine 180 is shown which can be used in connection with any of the previously described embodiments for size control shoes and microfinishing shoes. Microfinishing machine 180 is a so-called "masterless" type which allows the size control and microfinishing shoes to follow the orbiting motion of a journal surface such as the connecting rod journals of a crankshaft. Microfinishing machine 180 includes upper and lower support arms 182 and 184 which in turn support the microfinishing and size control shoes as shown. Microfinishing film 18 is shown passing through microfinishing shoe 14. Support arms 182 and 184 are pivotable about pins 186 in support bar 190. Hydraulic cylinder 188 acts on the support arms to cause them to clamp or unclamp the workpiece (shown clamped in FIGS. 11 through 13). Block 192 is fastened to bar 190 by pin 194 which permits it to pivot. Bar 190 engages rod 196 through pivot connection 198.

Support housing 200 defines a passageway for axial and pivotable movement of support arms 182 and 184, and includes plate 202 having an elongated rectangular slot 204 which block 192 travels in. Rod 206 is connected to block 192 and communicates with cylinder 208. Rod brakes 210 and 212 are provided for rods 196 and 212, respectively.

The progression of FIGS. 11 through 13 shows microfinishing machine 180 in operation. As shown, workpiece surface 12 is eccentrically rotated about the workpiece center of rotation 214 with clamping pressure being applied by cylinder 188. Support arms 182 and 184 follow the motion of the workpiece surface as it is rotated. During this process, the angular position of support arms 182 and 184 and the axial position of block 192 within slot 204 changes. Cylinder 208 is provided so that a pneumatic lifting force can be applied which at least partially counteracts the gravity force acting on the movable components, thus making the unit essentially "weightless" or neutral and thus enhancing its ability to follow the motion of the workpiece surface without undesirable external forces. During microfinishing operations with the size control shoes described previously, the clamping pressure applied by cylinder 188 is relieved once the desired workpiece diameter is achieved. The tooling is, however, kept in engagement with the workpiece to prevent damage to the tooling caused by collision which could occur if support arms 182 and 184 are opened while the workpiece is still moving. Rod brakes 210 and 212 are provided so that once rotation of the workpiece is stopped and cylinder 188 is actuated to disengage the workpiece, the shoes will be maintained to re-engage another workpiece. Rod brake 210 controls the angular positioning of support arms 182 and 184, whereas rod brake 212 controls the vertical positioning.

Figure 13A:
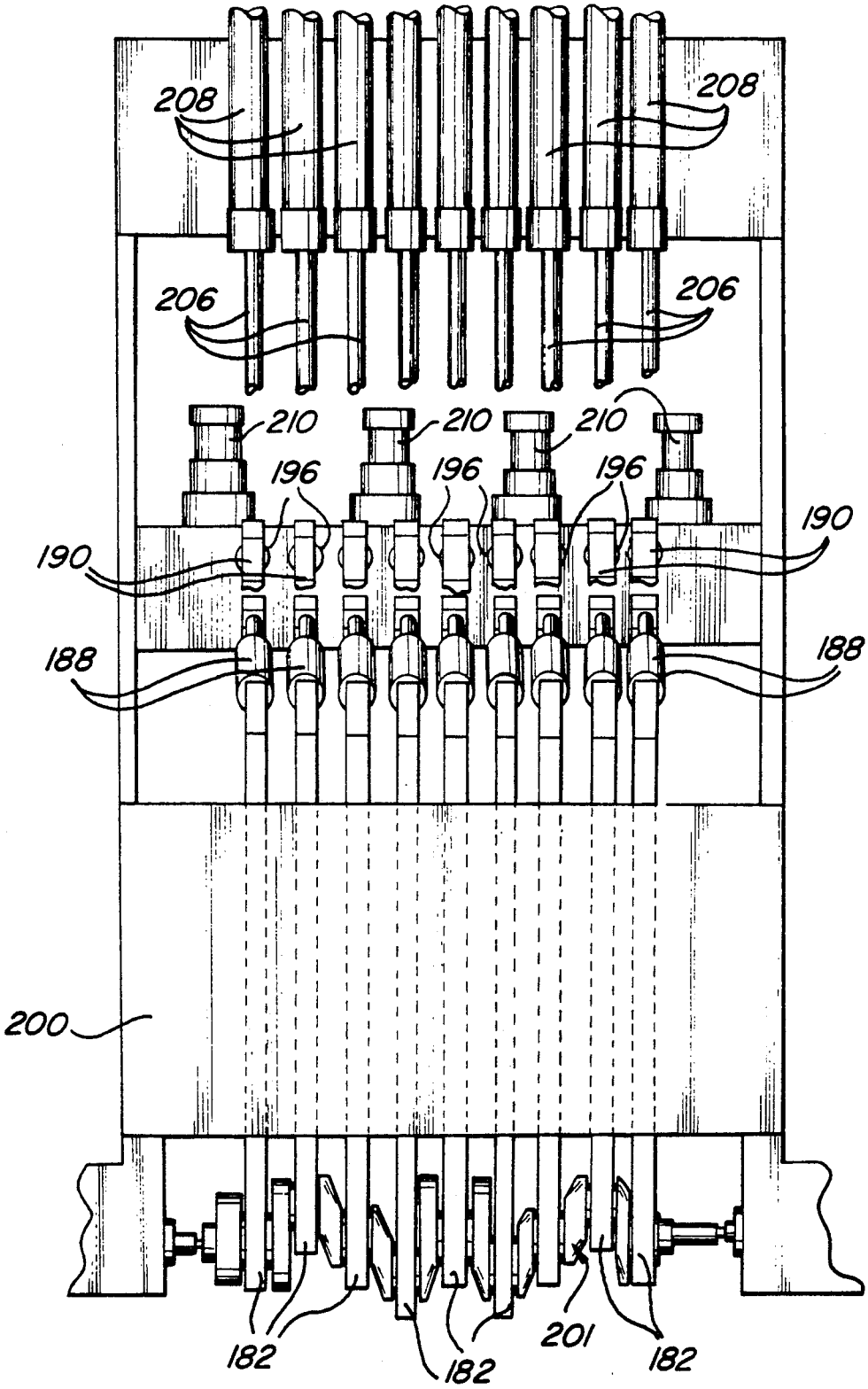
FIG. 13A is a front elevational view of the "masterless" type microfinishing machine shown in FIGS. 11–13 illustrating multiple size control and microfinishing shoe assemblies for simultaneously engaging each journal of a multi-cylinder internal combustion engine crankshaft.

FIG. 13A shows microfinishing machine 180 for use in microfinishing a multi-cylinder internal combustion engine crankshaft 201 having a number of journal surfaces. The machine 180 has a set of identical size control and microfinishing shoes carried by support arms 182 and 184 carried by support housing 200. The size control and microfinishing shoes are used to engage and simultaneously microfinish each journal of crankshaft 201. When one size control shoe provides an output indicative of the desired diameter for that journal, the pressure applied by that microfinishing shoe against the abrasive film on that journal is relieved, while machining continues on the other journals until the correct diameters are reached for each journal.

In addition to the above described size control shoes, these inventors have discovered operational steps which enhance the ability to provide a desired journal workpiece diameter. The abrasive grains covering film 18 tend to wear smooth on their leading edges with respect to the direction of relative motion between the film and the surface being finished. When a fresh surface of film 18 is indexed through shoe 14, initial rotation of workpiece journal 12 causes material to be removed at a high rate which decreases rapidly with continued rotation. If, however, the relative direction of movement of the journal surface across the film is reversed (e.g., by rotating journal 12 in an opposite direction), the material removal rate is again initially relatively high and then gradually decreases. Continued reversing of the relative direction of the workpiece causes high removal rates to occur during initial rotation for each reversal.

Figure 14:
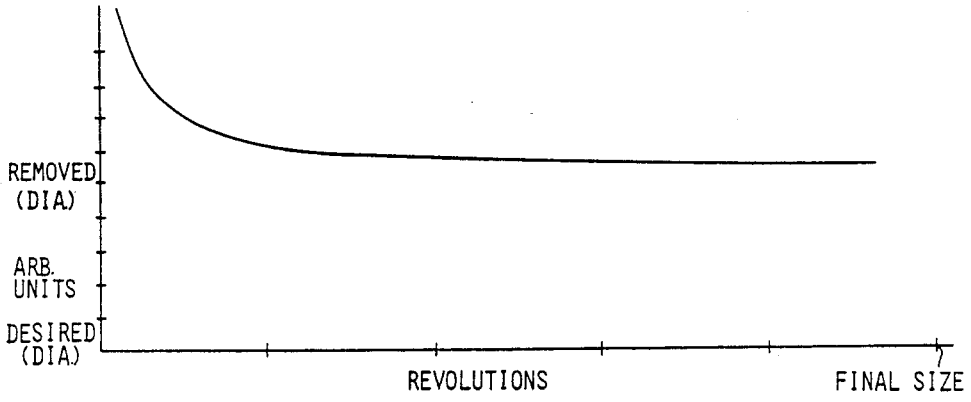
FIG. 14 is a graph showing workpiece diameter versus revolutions for a machining cycle in which the direction of rotation of the microfinishing shoe relative to the workpiece is maintained in a single direction.
Figure 15:
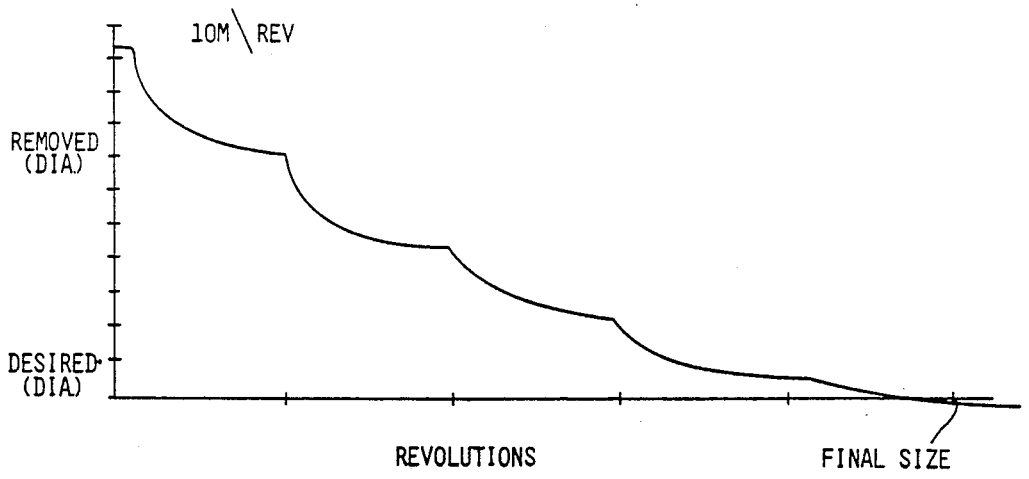
FIG. 15 is a graph showing workpiece diameter versus revolutions for a machining cycle in which the direction of rotation between the microfinishing shoe and workpiece is periodically reversed.

With reference to FIGS. 14 and 15, the workpiece diameter versus revolutions for non-reversing and reversing cycles are shown. The horizontal axis represents a desired diameter for the journal and the strategy point of the curve at zero revolutions represents the starting diameter. FIG. 14 illustrates the behavior of a microfinishing machine when it is operated in a single rotational direction. As shown, the rate of material removal is initially at a very high rate and decreases rapidly. This decrease in rate occurs since the abrasive film 18 "loads up" with metal grains taken off the workpiece. After approximately ten revolutions, the rate reaches a very low level and eventually going to zero such that no material is being removed. Without reversing, therefore, it is virtually impossible to remove a significant amount of material for size control unless a fresh surface of abrasive film is presented. FIG. 15 illustrates the workpiece diameter versus revolutions for a microfinishing machine for which the rotational direction of the workpiece is periodically reversed. FIG. 15 shows the characteristic curve of a machine which is reversed every five revolutions (i.e., rotations 1 to 5 are "clockwise" and 6 to 10 are "counterclockwise", etc.). As shown, the initial high rate of material removal is substantially reduced at the fifth revolution. However, upon reversing, the rate of material removal increases substantially and thereafter decreases as with the first cycle. The behavior follows a generally saw-toothed pattern through continuing cycles. As is evident in comparing FIGS. 14 and 15, the total amount of material that can be removed is substantially increased with the reversing direction cycle shown in FIG. 15.

Through development of microfinishing machines and processes, these inventors have determined that reversing the direction of rotation approximately every five to ten revolutions (five is shown in FIG. 15) for engine crankshafts produces an excellent combination of material removal rates and surface finish quality. Typical crankshaft journals can be microfinished to acceptable surface finish and geometry parameters through between two and fifteen reversing cycles. Due to the need to produce high accuracy microfinished surfaces, it is undesirable to reverse the direction of machining at near the desired diameter measurement. If reversal occurs just before a desired diameter is achieved, it is difficult for the equipment to react quickly enough to prevent overshooting the desired diameter due to the higher rate of material removal during initial rotation. Accordingly, microfinishing equipment employing size control shoes described herein are preferably operated to prevent the machine from reversing the direction of rotation of the workpiece once a predetermined difference between the diameter desired and that measured is reached. The correct diameter is therefore achieved when the rate of material removal is relatively low so that it can be approached with great accuracy. This method provides an excellent combination of high material removal rates along with dimensional accuracy, which are generally considered inherently incompatible parameters. FIG. 15 shows graphically an operational curve where the desired workpiece diameter is approached just prior to when a reversing of the direction of rotation is set to occur. As an example, the workpiece diameter is assumed to be nearly achieved at just before the twentieth revolution. Since reversing at close to achieving the desired diameter would generate a very high rate of material removal which could cause the tooling to "overshoot" the mark, the cycle is continued to the twenty-second or twenty-third revolution as shown in the figure until the desired diameter is achieved. The rate of material removal between the twenty-second and twenty-third revolution is at a relatively low rate, allowing the desired diameter to be approached slowly and thus enabling it to be reached with high precision.

While the above description constitutes the preferred embodiments of the present invention, it will be appreciated that the invention is susceptible of modification, variation and change without departing from the proper scope and fair meaning of the accompanying claims.

We claim:

1. A method of microfinishing a cylindrical workpiece surface comprising the steps of:

providing a microfinishing shoe for pressing an abrasive coated film against said workpiece surface, providing a gauge for continuously measuring the diameter of said workpiece surface, rotating said workpiece relative to said abrasive coated film in a first direction thereby causing material to be removed initially at a relatively high rate and thereafter at a relatively low rate, rotating said workpiece relative to said abrasive coated film in a second direction opposite said first direction thereby causing material to be removed initially at a relatively high rate and thereafter at a relatively low rate, and periodically reversing the direction of said rotation, preventing reversal of rotation from occurring when the measured diameter of said workpiece surface is less than a predetermined amount greater than a desired diameter such that the desired diameter is reached while material is being removed at said relatively low rate, and relieving the pressure applied by said film against said workpiece surface once the desired diameter is measured by said gauge.

2. The method of claim 1 wherein said workpiece is rotated approximately five to ten revolutions in each direction before reversing the direction of rotation of the workpiece.

3. The method of claim 1 wherein the direction of rotation is reversed between two and fifteen times during the microfinishing of the cylindrical workpiece surface.

4. A method of microfinishing a workpiece having a plurality of spaced cylindrical surfaces, comprising the steps of:

providing a microfinishing shoe for each cylindrical surface for pressing an abrasive coated film against said cylindrical surfaces;

providing a gauge for each cylindrical surface for continuously measuring each cylindrical surface diameter;

rotating said workpiece relative to said abrasive coated film in a first direction;

rotating said workpiece relative to said abrasive coated film in a second direction opposite said first direction;

periodically reversing the direction of rotation of said workpiece; and relieving the pressure applied by each shoe against the respective cylindrical surface once a predetermined diameter of the cylindrical surface is measured by the gauge for that cylindrical surface while said workpiece continues to rotate and microfinishing continues for the remaining cylindrical surfaces that have not reached a predetermined diameter.

5. The method of claim 4 further comprising the steps of:

providing an arm for mounting said shoe to a microfinishing machining;

rotating said arm about a pivot when microfinishing a cylindrical surface that is eccentric to the rotational axis of the workpiece; and linearly moving said pivot while said workpiece is rotated.

6. The method of claim 5 wherein said pivot is linearly moved in a generally vertical direction.

* * * * *